US005277592A

United States Patent [19]

Morlion

[11] Patent Number: 5,277,592

[45] Date of Patent: Jan. 11, 1994

[54] CONTACT ASSEMBLY

[75] Inventor: Danny L. C. Morlion, Ghent, Belgium

[73] Assignee: Burndy Corporation, Norwalk, Conn.

[21] Appl. No.: 913,273

[22] Filed: Jul. 14, 1992

[30] Foreign Application Priority Data

Jul. 16, 1991 [NL] Netherlands ..... 9101246

[51] Int. Cl.[5] ..... H01R 23/70

[52] U.S. Cl. ..... 439/65; 439/108; 439/825; 439/886

[58] Field of Search ..... 439/65, 67, 59, 62, 439/77, 493, 101, 108, 886, 825, 636, 637, 79, 80

[56] References Cited

U.S. PATENT DOCUMENTS 4,886,461 12/1989 Smith ..... 439/77

5,163,835 11/1992 Morlion et al. ..... 439/79

*Primary Examiner*—Neil Abrams

[57] ABSTRACT

A contact assembly, in particular for a connector for electrical connection between printed circuit boards, comprising a support of resilient conductive material, an insulation layer disposed on the support and at least one signal conductor disposed on the insulation layer, wherein each signal conductor includes signal contact pads. The support functions as ground conductor. In the insulation layer adjacent the signal contact pad(s) an opening is provided to expose a part of the support as associated ground contact pad.

The contact assemblies are manufactured by attaching a tape of conductive material to a tape of insulation material. A pattern of signal conductors is made from the tape of conductive material by means of a photolithographic process. Openings are formed in the tape of insulation material and said tape of insulation material with its side opposite to the signal conductors is attached on a support tape of resilient conductive material. Finally, contact assemblies with a plurality of signal conductors are punched out of the assembled tape.

8 Claims, 7 Drawing Sheets

CONTACT ASSEMBLY

BACKGROUND OF THE INVENTION

The invention relates to a contact assembly, in particular for a connector or the like, comprising a support of resilient conductive material, an insulation layer disposed on the support and at least one signal conductor disposed on the insulation layer, wherein the support functions as ground conductor and wherein each signal conductor includes signal contact pads.

Such a contact assembly is known for example from U.S. Pat. No. 3,401,369. Contact assemblies of this type are used in systems in which digital signals are transmitted at high speed, i.e. a low rise time, so that the electrical performance of the contact as circuit element is of high importance. By using these contact assemblies the signal conductors with the support functioning as ground conductor form transmission lines so that the signal conductors can be designed with a predetermined impedance.

In the contact assembly according to U.S. Pat. No. 3,401,369 a hole plated with a conductive material is made in the insulation layer to obtain a connection of the support at the side of the signal conductors whereby the manufacturing of the contact assembly becomes more complicated and thus costly.

SUMMARY OF THE INVENTION

The invention aims to provide a contact assembly of the above mentioned type wherein it is very simple to obtain a ground connection on the support at any desired location.

To this end the contact assembly according to the invention is characterized in that an opening is provided in the insulation layer adjacent the signal contact pad(s) to expose a part of the support as associated ground contact pad.

In this manner a contact assembly is obtained wherein manufacturing a connection to the support can simply be made through the opening in the insulation layer.

According to one embodiment of the contact assembly made in accordance with the present invention the ground contact pad is partially cut loose from the support, to obtain a ground contact tongue bent out of the plane of the support to cooperate with a complementary contact pad. Thereby the ground contact tongue can bent in any desired shape to cooperate with a complementary connection pad of a complementary contact assembly or a printed circuit board.

It is to be preferred according to the invention that as complementary contact assembly the ground contact pad is provided on a support part protruding from the support and bent backwards along 180° to the support in such a manner that the contact assembly has a substantially U-shaped cross-section at the location of the protruding support part and the ground contact pad lies opposite of the signal contact pad(s).

According to another embodiment of the present invention to be used as contact assembly for cooperation with an edge of a printed circuit board, the, support comprises a plurality of signal conductors arranged side by side on both sides of its center, wherein an opening is provided in the insulation layer at the opposite edges of the support for each signal conductor or group of signal conductors, said opening joining the corresponding edge, wherein the ground contact pads obtained by these openings are cut loose from the support starting at this edge to form one or more signal contact tongues and ground contact tongues at the edges of the support in an alternating manner, wherein all contact tongues are curved to provide contact locations for the signal contact tongues and the ground contact tongues at the side of the insulation layer and lying substantially in a common plane to contact corresponding contact pads of a printed circuit board.

The invention further relates to a method for manufacturing the contact assembly according to the invention, said method being characterized in that a tape of conductive material is attached on a tape of insulation material wherein a pattern of signal conductors is made from the tape of conductive material by means of a photolithographic process, wherein openings are formed in the tape of insulation material and said tape of insulation material with its side opposite to the signal conductors is attached on a support tape of resilient conductive material, wherein contact assemblies with a plurality of signal conductors are punched out of the assembled tape.

BRIEF DESCRIPTION OF THE DRAWINGS

The invention will be further explained by reference to the drawings in which some embodiments are schematically shown.

DETAILED DESCRIPTION OF THE INVENTION

Figure 1:
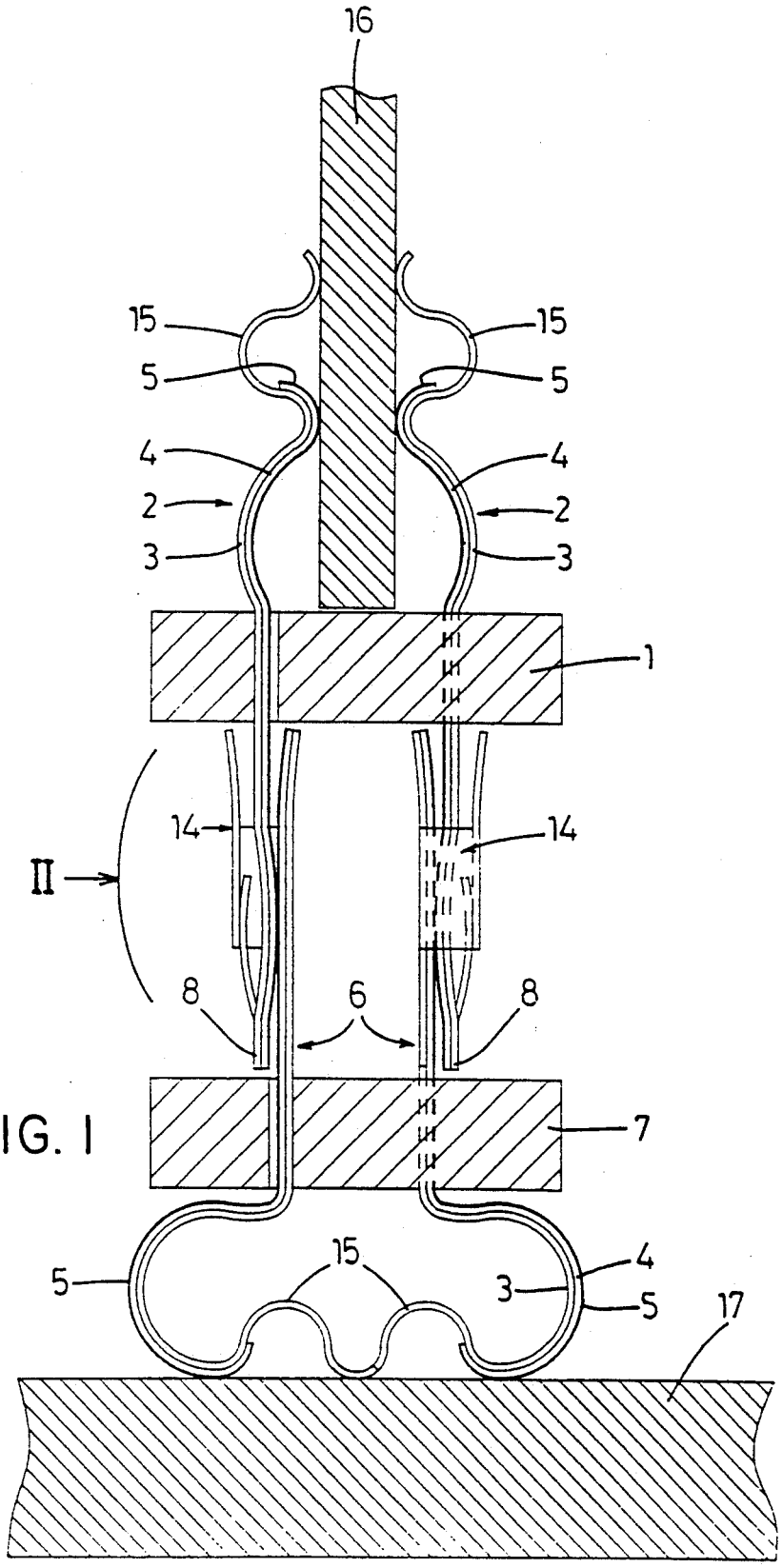
FIG. 1 schematically shows a cross-section of a connector assembly for printed circuit boards comprising male and female contact assemblies according to a first embodiment of the invention.

In accordance with the present invention a connector assembly (FIG. 1) is provided with a first connector part 1 in which two rows of male contact assemblies 2, two of which are shown in FIG. 1. Each male contact assembly 2 comprises a support 3 of resilient conductive material. An insulation layer 4 is provided on the support 3 and on this insulation layer 4 two signal conductors 5 are disposed as is shown in the cross-section of FIG. 3. It is also possible to provide one or more than two signal conductors 5 on each contact assembly.

Figure 2:
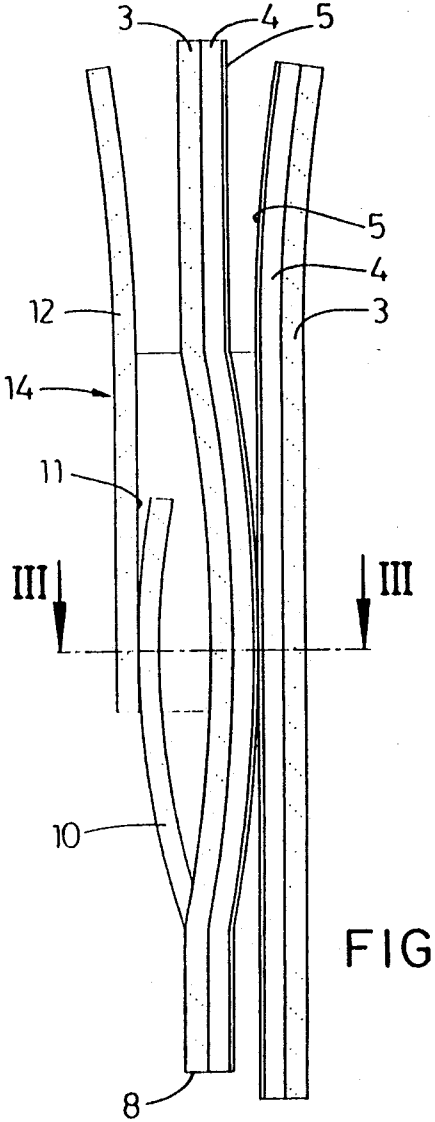
FIG. 2 shows the part II of FIG. 1 in a larger scale.

As shown in FIG. 1, the male contact assemblies 2 cooperate with female contact assemblies 6 mounted in rows in a connector part 7. Mainly in the same manner as the contact assemblies 2 the contact assemblies 6 are made with a support 3, an insulation layer 4 and two signal conductors 5 formed on this insulation layer and more clearly shown in FIGS. 2 and 3.

Figure 3B:
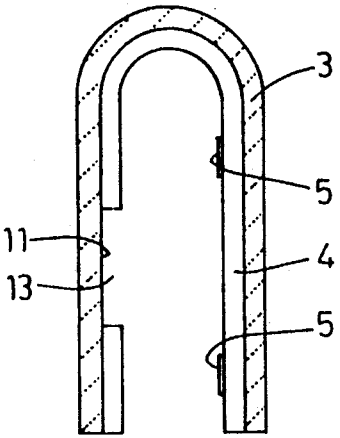
FIG. 3*a*–3*c* show a cross-section taken on the line III—III of FIG. 2 of both contact assemblies and in the position if FIG. 2.
Figure 3A:
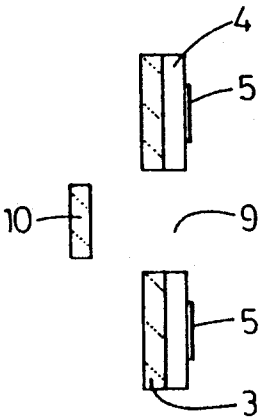

Adjacent a first edge 8 of the male contact assembly 2 an opening 9 shown in FIG. 3*a* is provided in the insulation layer 4, through with opening 9 a part 10 of the support 3 is exposed or accessible as ground contact pad. In the male contact assembly 2 the ground contact pad 10 is cut loose from the support 3 so that a ground contact tongue is obtained, bent out of the plane of the support 3, in this case in a direction opposite to the signal conductors 5.

In case of the female contact assemblies 6 a ground contact pad 11 is formed at a support part 12 projecting from the support 3, which ground contact pad 12 is obtained by means of an opening 13 in the insulation layer 4 as shown in FIG. 3*b*. This support part 12 is bent backwards along 180° to the support 3 so that a partially open socket part 14 with a substantially U-shaped cross-section is obtained.

Figure 3C:
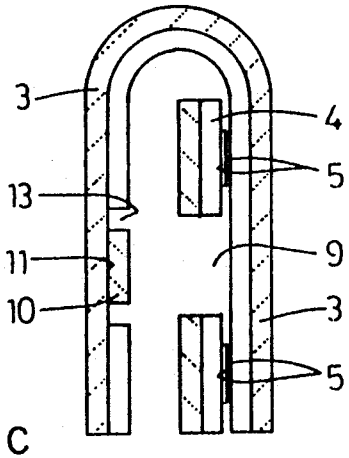

Within the socket part 14 of the contact assembly 6 the ground contact tongue 10 of the contact assembly 2 contacts the ground contact pad 11 and the signal contact pads of the signal conductors 5 of the contact assembly 2 contact the signal contact pads of the signal conductors 5 of the contact assembly 6, as shown in FIG. 3*c*.

At the male contact assembly 2 at the other edge of the support 3 a support strip 15 is formed for each signal conductor 5 as will be further explained hereinafter. This support strip 15 projects beyond the insulation layer 4 and the complete support strip has a double wave shape in such a manner that the end of each signal conductor 5 lies as a signal contact pad substantially in one plane with the end of the support strip 15 functioning as ground contact pad. These contact pads are connected to corresponding contact pads of a printed circuit board 16, for example by soldering.

At the female contact assembly 6 at the side opposite of the socket part 14 the support 3 in the same manner as in the contact assembly 2 comprises support strips 15, the end of which projects beyond the insulation layer 4. The support strips 15 are also bent in a double wave shape in such a manner that the signal conductor 5 of the support strip 15 and the free end of the support strip are substantially in one plane and can be attached to corresponding contact pads of a printed circuit board 17, for example by soldering.

Figure 4:
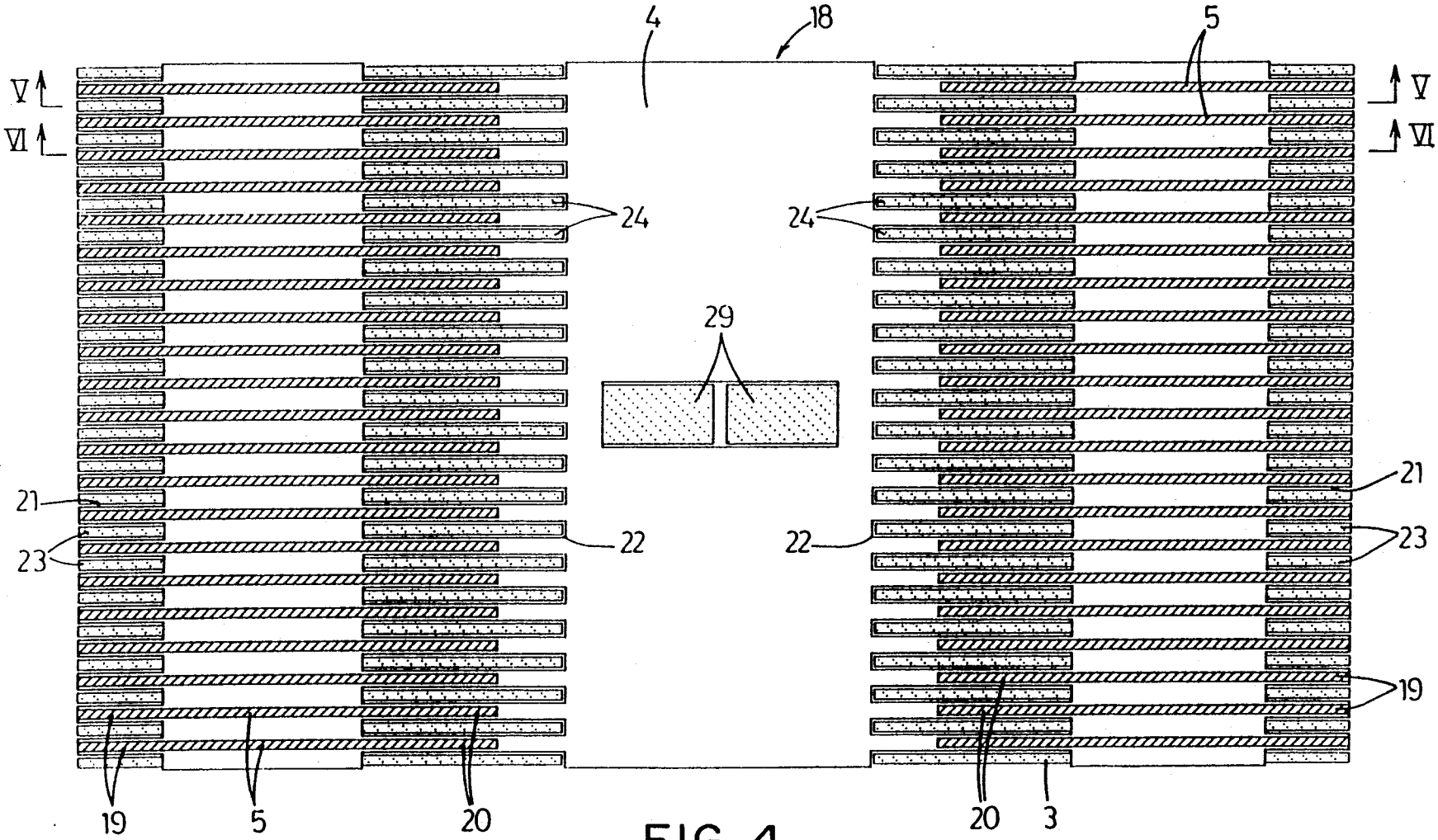
FIG. 4 is a top view of an alternative embodiment of the contact assembly according to the invention in a flat shape.
Figure 5:
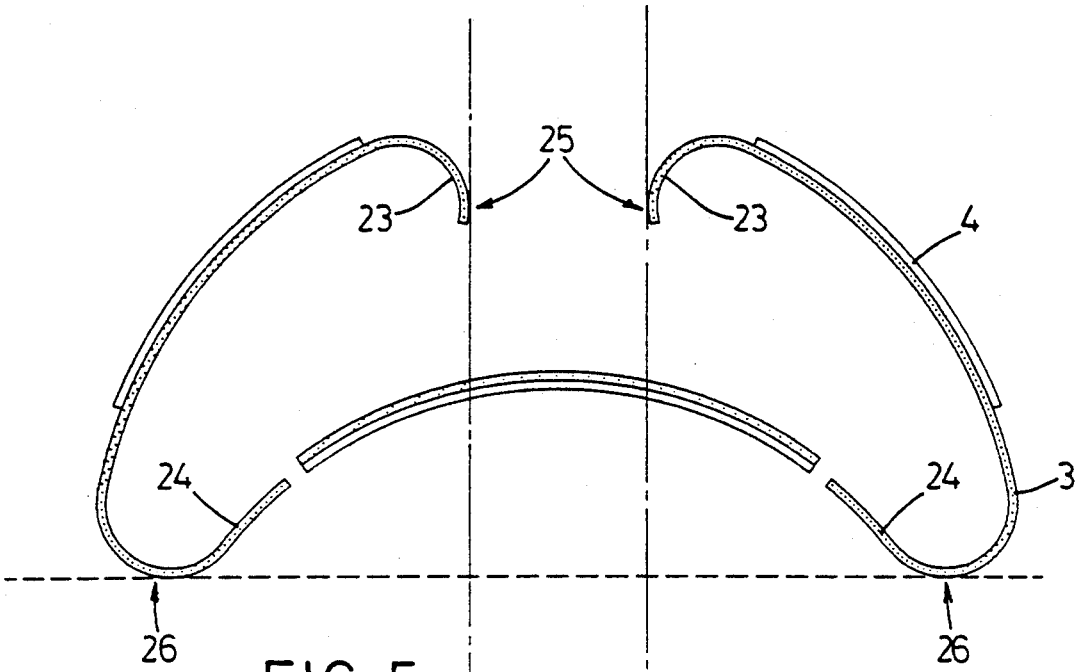
FIG. 5 is a cross-section taken on the line V—V of the contact assembly of FIG. 4 in a curved shape.
Figure 6:
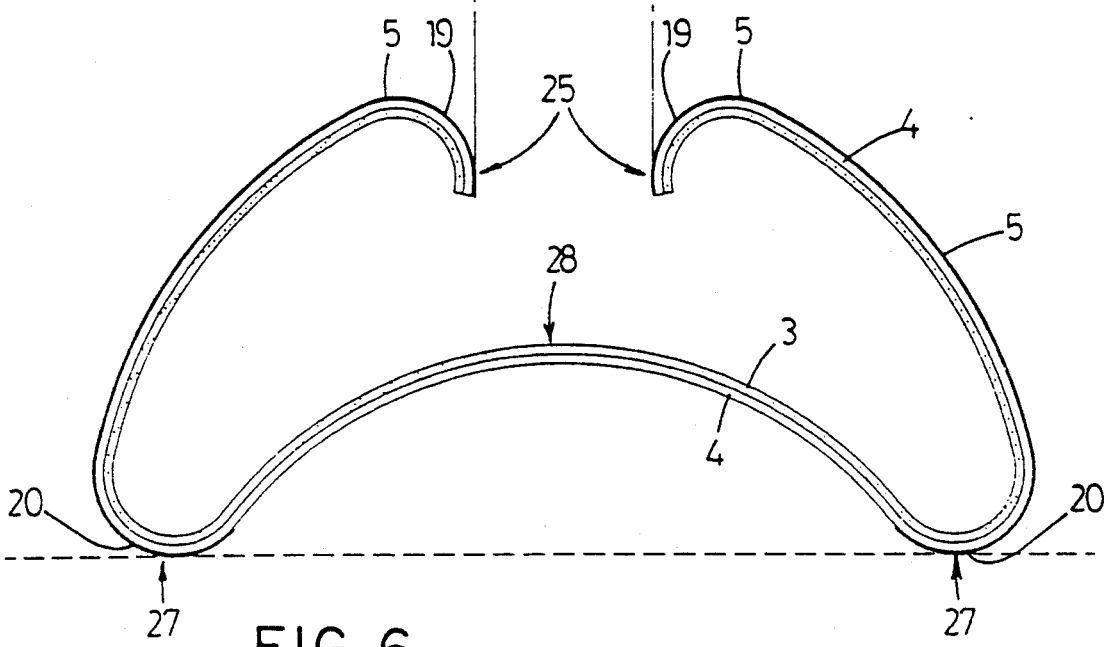
FIG. 6 is a cross-section taken on the line VI—VI of the contact assembly of FIG. 4 in a curved shape.

FIGS. 4–6 show a contact assembly 18 which, in the same manner as the contact assemblies 2, 6, is composed of a support 3, an insulation layer 4 and signal conductors 5. FIG. 4 shows that the signal conductors 5 lie in two groups on both sides of the centre of the support 3. The ends 19, 20 of the signal conductors 5 function as signal contact pads. On both sides of each signal contact pad 19, 20 an opening 21, 22, respectively, is made in the insulation layer 4 so that parts 23, 24 of the support 3 are accessible through these openings 21, 22. The openings 21 at the edges of the support 3 join these edges. The parts 23, 24 exposed through the openings 21, 22 are cut loose from the support 3 so that a ground contact tongue 23 and a signal contact tongue 19 are provided along the edges of the support 3 in an alternating manner. The cross-sections of FIG. 5 and 6 show that these contact tongues 19, 23 are curved in such a manner that the signal contact tongues 19 and the ground contact tongues 23 at the side of the insulation layer 4 have contact locations 25 lying substantially in a common plane, wherein the contact tongues 19, 23 with these contact locations 25 can contact corresponding contact pads of a printed circuit board not further shown.

The ground contact tongues 24 formed by the exposed parts of the support 3 and directed towards the centre of the support 3 are curved in such a manner that projecting contact locations 26 as indicated in FIG. 5 are obtained. At the location of the contact tongues 24 the support 3 is curved in a corresponding manner, so that contact locations 27 for the signal contact pads 20 as indicated in FIG. 6 are obtained, lying in one common plane with the contact locations 26 and all contact locations 26, 27 being adapted to contact corresponding contact pads of a printed circuit board.

The overall shape of the contact assembly 18 is clearly shown in FIG. 5 and 6. The centre part 28 of the contact assembly has an upwardly directed curve. The contact assembly 18 is appropriate for a connector in which an edge with contact pads of a printed circuit board is inserted, said edge pushing on this curved centre part 28 and thereby moving the contact tongues 19, 23 towards each other so that these contact tongues 19, 23 can contact the contact pads of the inserted printed circuit board.

The lips 29 (FIG. 4) formed in the curved centre part 28 are bent downwards out of the plane of the support 3 and function to centre the contact assembly 18 in a housing not further shown.

It is noted that at the edge of the support 3 of the contact assemblies 2, 6 with the support strips 15, instead of these support strips an opening can be made in the insulation layer 4 in the same manner as at the contact assembly 18, wherein the exposed support part can be partially cut loose starting at the edge. Thereby signal contact tongues and a ground contact tongue are obtained, which are adapted to contact corresponding contact pads of a printed circuit board in the same manner as the contact tongues 19, 23.

Referring to FIG. 7–9 the manufacturing of the contact assemblies 2, 6 and 18 described will be further explained.

As shown in FIG. 7*a*–7*d* and 8*a*–8*d* the male and female contact assemblies 2 and 6, respectively, are made in substantially the same manner. A tape 31 of conductive material is attached to a tape 30 of insulating material, whereafter a pattern of signal conductors 5 is made out of the conductive material 31 by means of a photolithographic process known per se, said signal conductors 5 extending transverse to the longitudinal direction of the tape 30, 31. As insulation material for the tape 30 polyimide is used, for example. The conductive material of tape 21 is copper, for example.

Figure 7A:
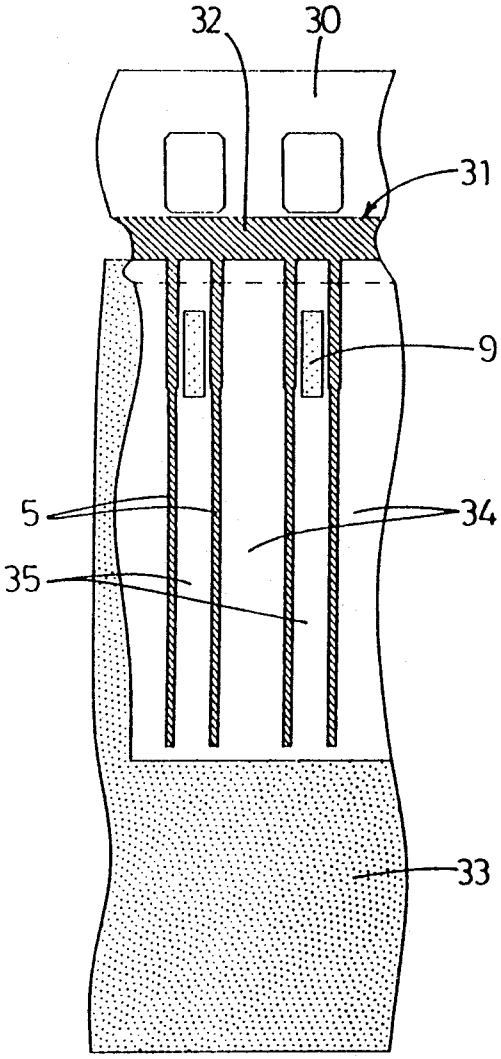
Figures 8A, 8B, 8C, 8D:
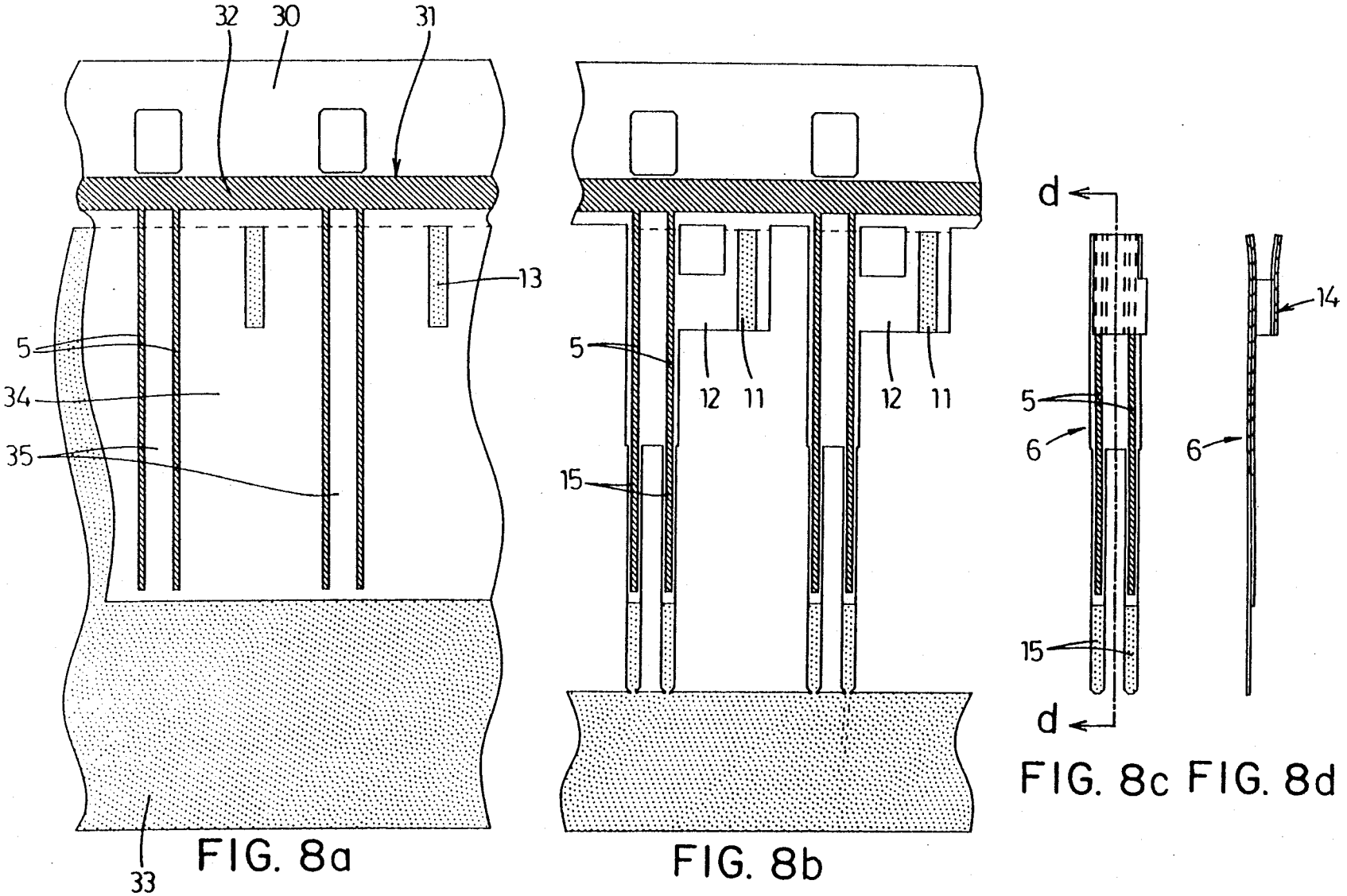
FIG. 8*a*–8*d* schematically show subsequent steps in manufacturing the female contact of FIG. 1.

Openings 7 and 13, respectively, are made in tape 30 of an insulation material. Subsequently the tape 30 with the signal conductors 5 formed on the same and connected to each other through a longitudinal strip 32, is attached on a support tape 33 which is made of a resilient conductive material, preferably copper-beryllium. As shown in FIG. 7*a*, 8*a* the support tape 33 protrudes with respect to the tape 30 of insulation material. Parts of the support tape 33 are accessible through the openings 7, 13. The attachment of the tape 30 on the support tape 33 occurs by means of an adhesive layer which is provided on the side of the tape 30 opposite to the signal conductors 5 before making the openings 7, 13 in the tape 30. The tape 31 is also attached on the tape 30 by means of an adhesive layer. The adhesive layer is activated by heating.

Figures 7C, 7D:
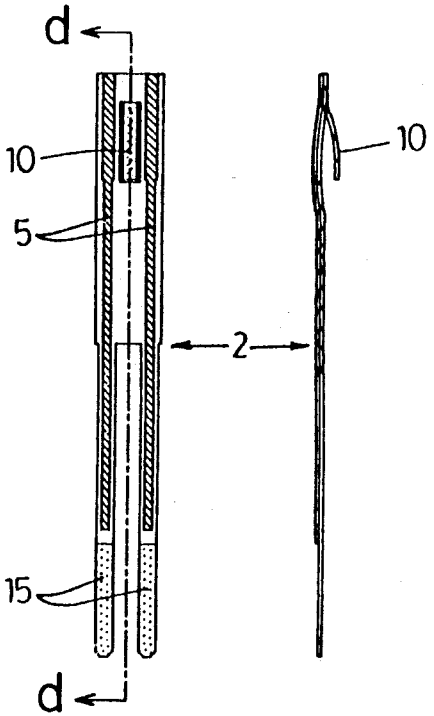
FIG. 7*a*–7*d* schematically show subsequent steps for manufacturing the male contact of FIG. 1.
Figure 7B:
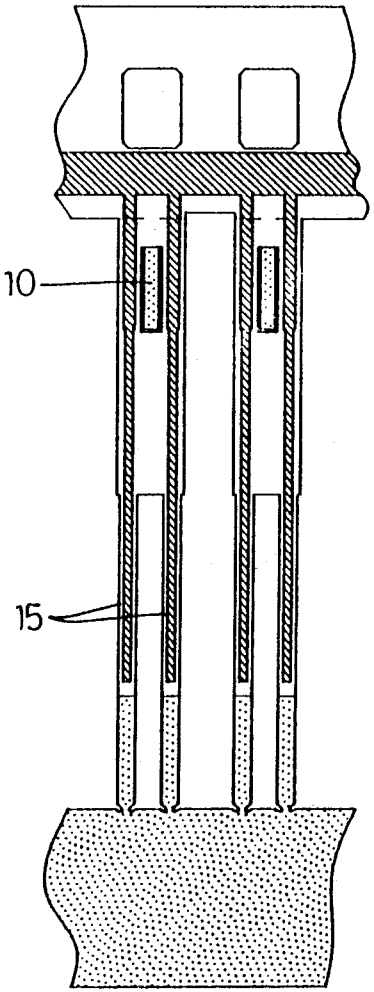

As appears from FIG. 7 the parts 10 of the support tape 3 accessible through the openings 9 are partially cut loose from the support tape 33 so that these parts 10 can be bent out of the plane of the support to obtain a ground contact tongue, which is shown in FIG. 7*d*. Further subsequent contact assemblies 2 are made by punching out intermediate parts 34. A part 35 of the tape assembly 30, 31, 33 is punched out, so that support strips 15 are obtained. Finally the side edges of the assembled tape 30, 31, 33 are removed whereby the contact assemblies 2 according to FIG. 7*c* are obtained.

In FIG. 8*b* there is shown that also in manufacturing the female contact assemblies 6 intermediate parts 34 are punched out wherein however the support part 13 is maintained for making the socket part 14 as shown in FIG. 8*c*–8*d*. In the female contact assembly 6 the support part accessible through the openings 13 is not cut loose and this support part is accessible through the opening 13 as ground contact pad 11 for the ground contact tongue 10 of the male contact assembly 2. In the same manner as for the male contact assembly 2 intermediate parts 35 of the assembled tape 30, 31, 33 are punched to obtain the support strips 15.

Figure 9C:
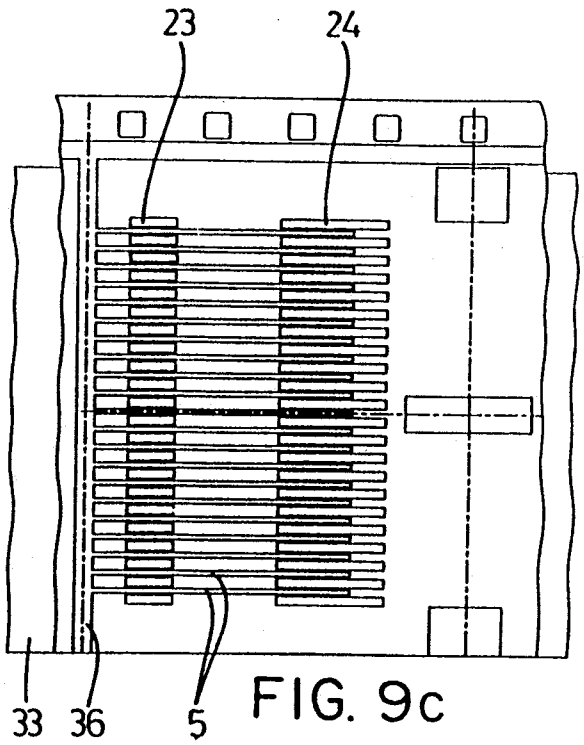
FIG. 9*a*–9*c* schematically show some steps in manufacturing the contact assembly of FIG. 4 in a top view.
Figure 9B:
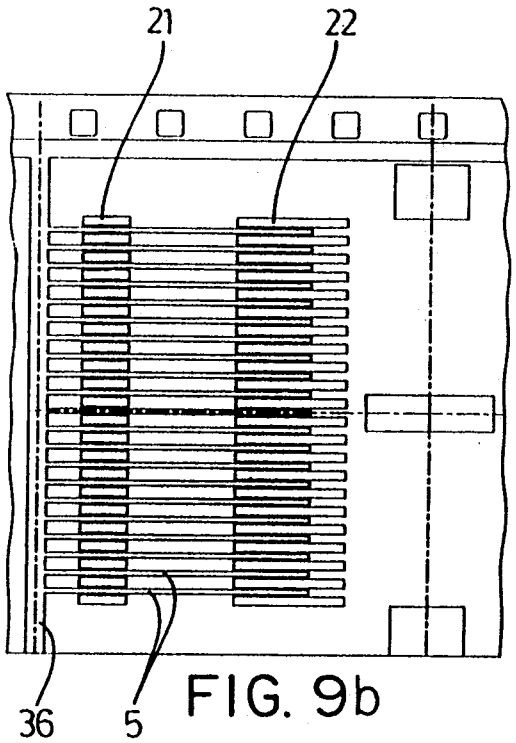
Figure 9A:
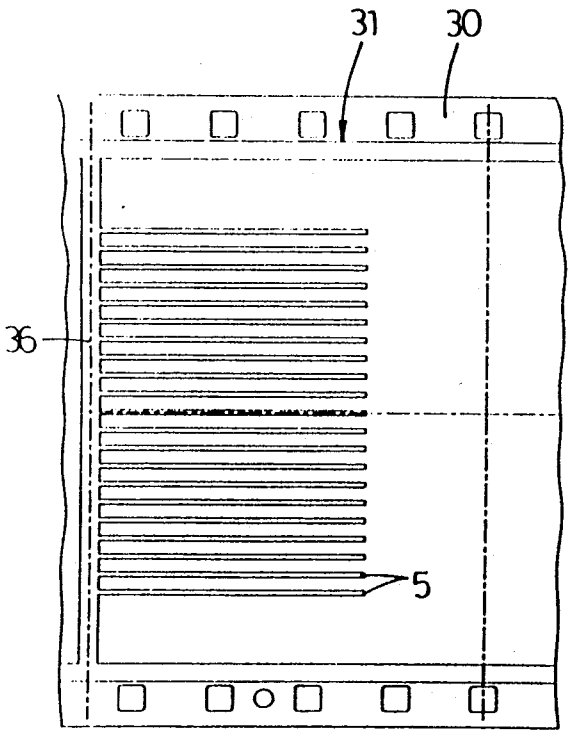

In FIG. 9*a*–9*c* some intermediate phases in manufacturing the contact assembly 18 according to FIG. 4–6 are shown. This manufacturing mainly corresponds with the manufacturing of the contact assemblies 2, 6 according to FIG. 7 and 8. Also in this case a tape 31 of conductive material is attached on a tape 30 of insulation material, wherein a pattern of signal conductors 5 is made by means of a photolithographic process, which signal conductors in this case extend in the longitudinal direction of the tape 31. At one end the signal conductors 5 are connected to a transverse strip 36. Subsequently openings 21 and 22 are made in the tape 30 of insulation material as shown in FIG. 9*b*, whereafter the tape 30 is attached on the support tape 33 of resilient conductive material by means of an adhesive layer provided before making the openings 21, 22. In this manner the assembled tape 30, 31, 33 shown in FIG. 9*c* is obtained. As shown by a comparison of FIG. 9*a* and 9*b* an edge part of the tape 30 is cut away before attaching the same on the support tape 33. Finally contact assemblies 18 each having two groups of signal conductors 5 are punched out of the assembled tape 30, 31, 33, whereby contact assemblies 18 with the configuration shown in FIG. 4 are obtained. The step of partially cutting loose the exposed parts of the support tape 33 may occur before or after punching the contact assemblies 18 from the tape.

It is noted that the tape 31 of conductive material is subjected to a deoxidation before the same is attached to the tape 30. Further the signal conductors can be plated with nickel and gold, if desired, or could be provided with another suitable plating. The support tape 33 is also subjected to a deoxidation before the tape 30 is attached to the same.

The invention is not restricted to the above-described embodiments which can be varied in a number of ways within the scope of the claims.

I claim:

1. A contact assembly, in particular for a connector or the like, comprising a support of resilient conductive material, an insulation layer disposed on the support and at least one signal conductor disposed on the insulation layer, wherein the support functions as ground conductor and wherein each signal conductor includes signal contact pads, characterized in that an opening is provided in the insulation layer adjacent the signal contact pad(s) to expose a part of the support as associated ground contact pad for said adjacent signal contact pad(s).

2. A contact assembly according to claim 1, characterized in that the ground contact pad is partially cut loose from the support, to obtain a ground contact tongue bent out of the plane of the support to cooperate with a complementary contact pad.

3. A contact assembly according to claim 1, characterized in that the ground contact pad is provided on a support part protruding from the support and bent backwards along 180° to the support in such a manner that the contact assembly has a substantially U-shaped cross-section at the location of the protruding support part and the ground contact pad lies opposite of the signal contact pad(s).

4. A contact assembly according to claim 1, characterized in that the support includes a support strip for each signal conductor and which strip projects beyond the insulation layer, to provide a ground contact pad.

5. A contact assembly according to claim 4, characterized in that each support strip is bent into a double wave shape in such a manner that the signal conductor and the end of the support strip can be connected to a printed circuit board.

6. A contact assembly according to claim 1, characterized in that the support comprises a plurality of signal conductors disposed thereon in side by side relationship on both sides of the center of the support and, wherein an opening is provided in the insulation layer at the opposite sides of the support, a signal conductor or group of signal conductors interposed between said openings and wherein the ground contact pads are provided on said support within said openings and are cut loose from the support to form one or more signal contact tongues and ground contact tongues at the edges of the opening in an alternating manner, wherein all contact tongues are curved to provide contact locations for the signal contact tongues and the ground contact tongues at the side of the insulation layer and lying substantially in a common plane to contact corresponding contact pads of a printed circuit board.

7. A contact assembly according to claim 1, characterized in that the signal conductors terminate in a signal contact pad at a predetermined distance from the center of the support, and wherein substantially at the location of the signal contact pads said openings are provided in the insulation layer to expose said parts of the support as ground contact pads partially cut loose from the support in such a manner that ground contact tongues directed to the centre of the support are formed, and wherein the support is curved at the location of the ground and signal contact pads to obtain contact locations for the ground and signal contact pads at the side of the insulation layer and lying substantially in a common plane to contact corresponding contact pads of a second printed circuit board.

8. A contact assembly according to claim 1 characterized in that a plurality of spaced openings are provided in said insulation layer, said signal conductors disposed on said insulation layer and interposed between said openings, said support portions exposed in said openings as ground contacts and which exposed portions are cut loose from said support at the edges of said openings to form one or more signal contact tongues and at least one ground contact tongue.

* * * * *